US005940914A

United States Patent [19]

Robbins

[11] Patent Number: 5,940,914

[45] Date of Patent: Aug. 24, 1999

[54] APPARATUS FOR INSTALLING A VIBRATION DEVICE IN A BED SYSTEM

[75] Inventor: Daniel J. Robbins, Miami Beach, Fla.

[73] Assignee: Magic fingers of America, Inc., Miami Beach, Fla.

[21] Appl. No.: 08/911,541

[22] Filed: Aug. 14, 1997

[51] Int. Cl.[6] ..... A47C 27/00

[52] U.S. Cl. ..... 5/694; 5/109; 5/915

[58] Field of Search ..... 5/108, 109, 694, 5/915, 259.1; 24/457, 458, 520; 248/302, 303

[56] References Cited

U.S. PATENT DOCUMENTS

| | | | |
|---|---|---|---|
| 793,853 | 7/1905 | Smith | 5/259.1 |
| 814,556 | 3/1906 | Miller | 24/601.8 |
| 1,141,145 | 6/1915 | Rickerd | 5/259.1 |
| 2,980,108 | 4/1961 | Scott | 5/109 |
| 3,194,522 | 7/1965 | Azneer | 5/109 X |
| 3,455,296 | 7/1969 | McCaleb | 5/915 X |
| 4,328,598 | 5/1982 | Evanson | 5/109 |
| 5,331,507 | 7/1994 | Kyung et al. | 24/458 X |

FOREIGN PATENT DOCUMENTS

| | | | |
|---|---|---|---|
| 708791 | 5/1965 | Canada | 5/915 |

*Primary Examiner*—Michael F. Trettel
*Attorney, Agent, or Firm*—Haynes & Boone, LLP

[57] ABSTRACT

An assembly for vibrating a bed system, such as a box spring mattress. The assembly includes a clip system, a vibrating device with a housing that has several slots to engaging a lattice wire inside a box spring mattress as well as the clip system. The clip system is used to secure the vibrating device to the box spring mattress. The clip system includes a tension portion that has a mounting portion to engage the slots of the vibrating device and an indentation portion, extending from the mounting portion, to engage the other slots of the vibrating device. The clip system is secured to the box spring mattress with locking ties. Alternatively, the clip assembly includes a support clip for engaging the lattice wire and the slots of the vibrating device, instead of the slots directly engaging the lattice wire.

18 Claims, 3 Drawing Sheets

APPARATUS FOR INSTALLING A VIBRATION DEVICE IN A BED SYSTEM

BACKGROUND OF THE INVENTION

The present invention relates generally to an apparatus for installing a vibrating device and, more particularly, to a clip system for installing a vibrating device in a box spring mattress, futon or other similar bed systems.

The known methods of installing a vibrating device inside a box spring mattress have become ineffective due to changes in the design of the support springs in the box spring mattress. Prior to the changes in the design of box spring mattresses, the support springs were coil shaped. This coil design allowed a user of a vibrating device, with four circular posts, to simply screw the device housing into the coil design via the circular posts.

Presently, typical box spring mattresses are made with a series of parallel lattice wires in conjunction with spring coils to create a lattice within the box spring mattress. These parallel wires prevent the insertion of the vibration device in the spring coils due to different spacing widths in the various grid systems. Furthermore, other bed systems, such as a futon bed, have supporting frames with parallel boards. These parallel boards prevent the installation of the vibrating device for the reasons set forth above.

Therefore, what is needed is an assembly to enable the user to attach the vibrating device to the lattice arrangement of any type of box spring mattress or similar bed system.

SUMMARY OF THE INVENTION

The present invention, accordingly, provides an assembly that enables the user to secure a vibration assembly to the lattice arrangement of any box spring mattress. To this end, a clip system secures a vibrating device having a housing and several slots, with one slot engaging a lattice wire inside a box spring mattress, to the box spring mattress, the clip system includes a mounting portion to engage the slots of the vibrating device and an indentation portion, connected to the mounting portion, which is secured to the box spring mattress with a locking nylon tie. The clip system also includes a support clip for engaging the lattice wire and the slots of the vibrating device, instead of the slots directly engaging the lattice wire.

A principal advantage of this embodiment is that it allows the user of a vibrating device to secure it to any type of box spring mattress or similar bed system.

DETAILED DESCRIPTION OF THE PREFERRED EMBODIMENT

Figure 1:
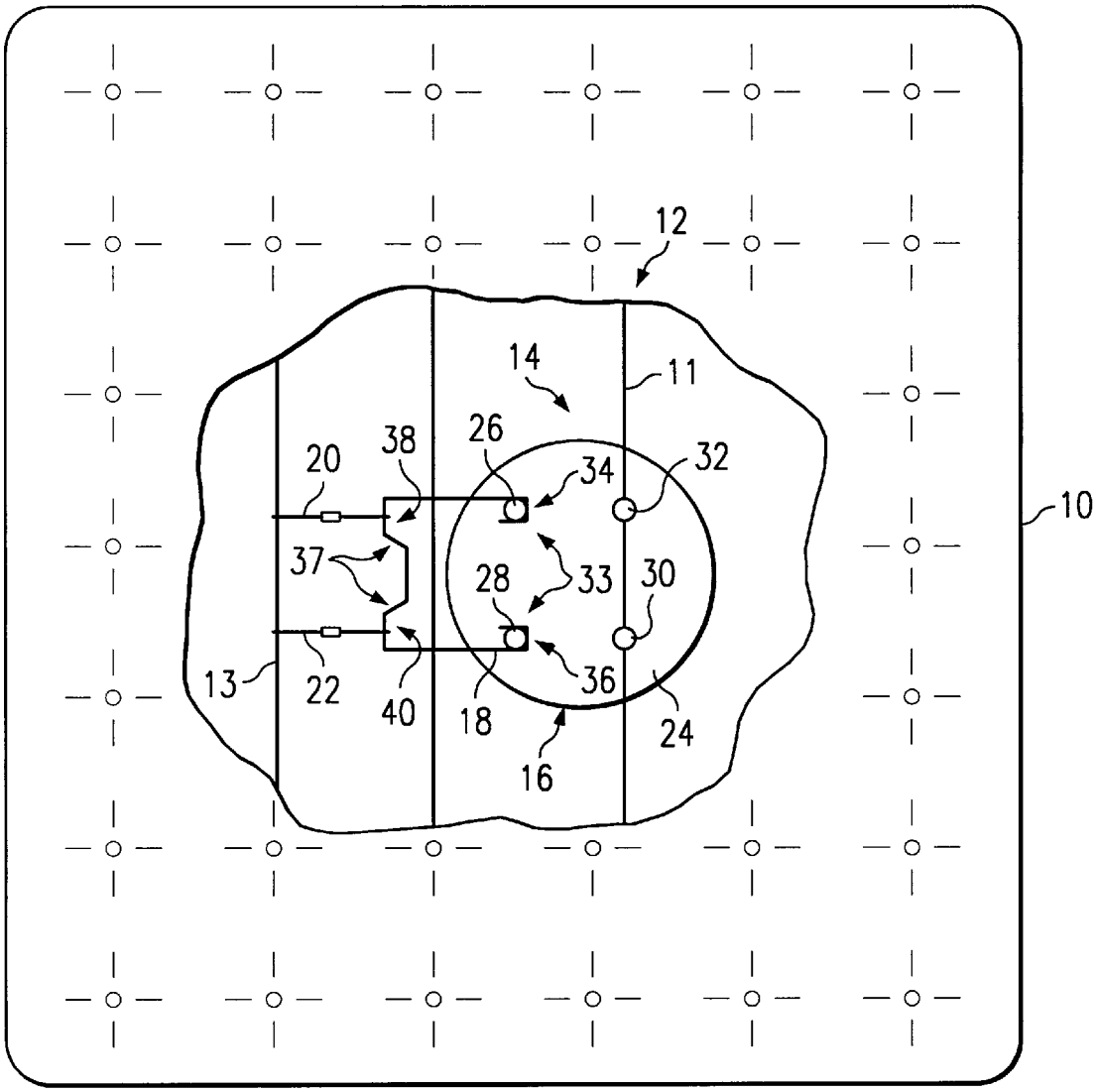
FIG. 1 is a cut-away of a bed system, such as a box spring mattress, illustrating how a vibrating device is installed using a clip assembly.

FIG. 1 shows a box spring mattress 10 with a cut away section, generally designated 12, to reveal a vibration assembly, generally designated 14. The vibration assembly 14 engages a first lattice wire 11 and a second lattice wire 13 of the box spring mattress in order to vibrate the box spring mattress 10. The vibration assembly 14 includes a vibrating device, generally designated 16, a tension clip 18, and a pair of locking ties 20 and 22. The vibrating device 16 has a housing 24 with a first slot 26, a second slot 28, a third slot 30, and a fourth slot 32. The third slot 30 engages the first lattice wire 11. Similarly, the fourth slot 32 engages the first lattice wire 11. The tension clip 18 has a mounting portion, generally designated 33, and an indentation portion, generally designated 37, which is discussed in detail below in relation to FIG. 3. The mounting portion 33 has a left hook piece 34 and a right hook piece 36 that engage the first slot 26 and the second slot 28, respectively. The indentation portion 37 has a first indentation 38 and a second indentation 40 which is secured to the second lattice wire 13 using a first locking tie 20 and a second locking tie 22, respectively. Ties 20 and 22 are conventional locking ties wherein one end as a locking mechanism (not shown) and the other end engages the locking mechanism to create a loop that can resist opposing forces. Ties 20 and 22 are wrapped around the second lattice wire 13 and secure the tension clip 18 to the box spring mattress 10, which in turn secures the vibrating device 16 to the box spring mattress 10.

Figure 2:
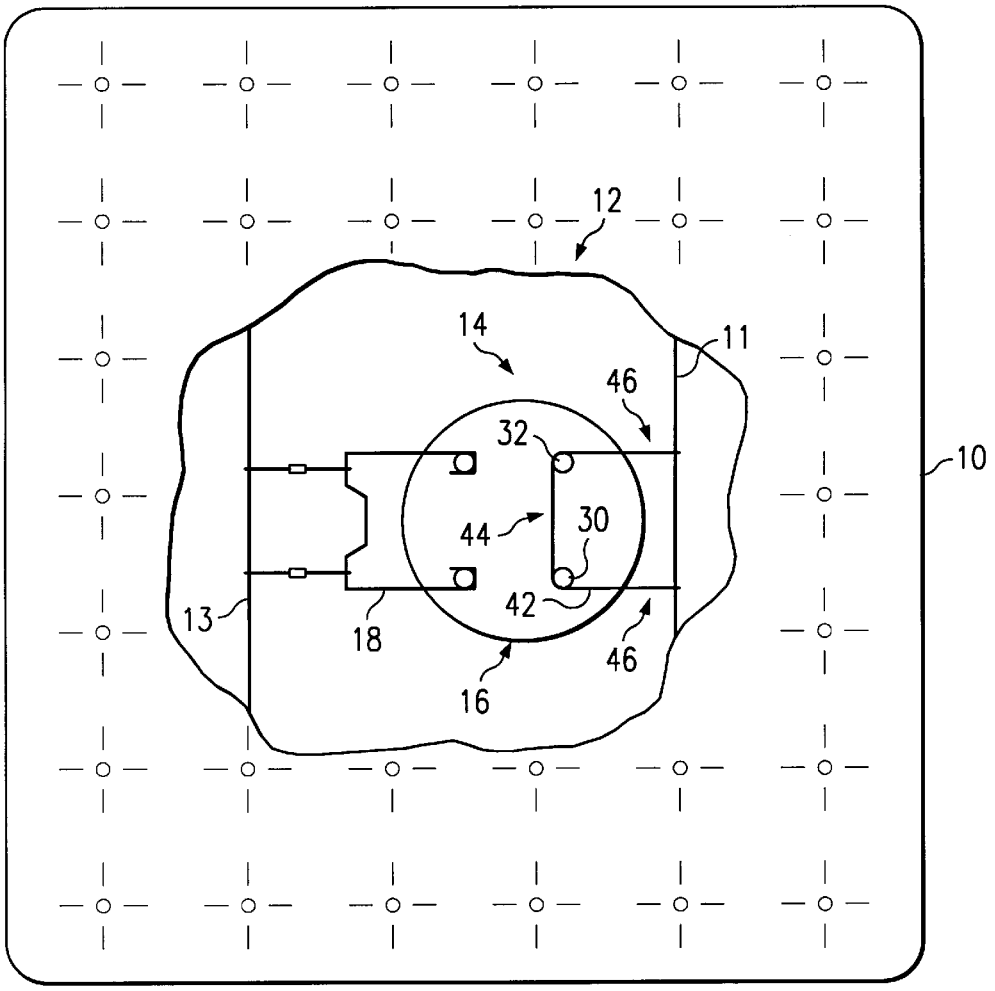
FIG. 2 is another cut-away of the box spring mattress illustrating how a vibrating device is installed using another embodiment of the clip assembly.

FIG. 2 shows another embodiment wherein the vibration device 16 engages a support clip 42 instead of the first lattice wire 11. The support clip 42 has a support portion, generally designated 44, and a hook portion, generally designated 46. The support portion 44 engages the third slot 30 and the fourth slot 32, which is discussed in detail below in relation to FIG. 4. This allows the vibrating device 16 to be secured to any box spring mattress regardless of the spacing between the lattice wires.

Figure 3:
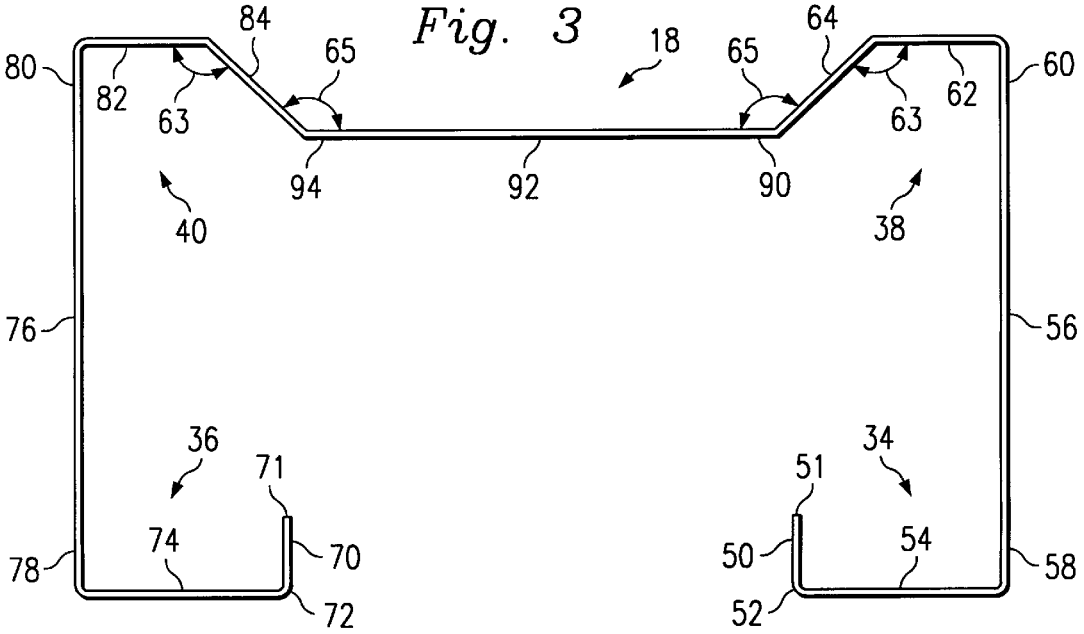
FIG. 3 is the tension clip used in FIG. 1 and FIG. 2 to secure the vibrating device to the box spring mattress.

In FIG. 3, the tension clip 18 is shown with the left hook piece 34, the right hook piece 36, the first indentation 38, and the second indentation 40. Left hook piece 34 includes a first finger 50, which has a free end 51 and an angled end 52, a first handle 54, and a first arm 56. The first arm 56 has a handle end 58 and a tension end 60. The handle end 58 attaches to one end of the first handle 54. Another end of the first handle 54 attaches to the angled end 52 of the first finger 50.

In a similar arrangement, the right hook piece 36 has a second finger 70, which has a free end 71 and an angled end 72, a second handle 74, and a second arm 76. The second arm 76 has a handle end 78 and a tension end 80. The handle end 78 attaches to one end of second handle 74. The other end of second handle 74 attaches to the angled end 72 of the second finger 70.

The first indentation 38 is made of a first shoulder 62 attached to a first neck 64 at a first angle designated 63. Likewise, the second indentation 40 is made of a second shoulder 82 attached to a second neck 84 at the first angle 63. The first neck 64 is attached to a left end 90 of a cross member 92 at a second angle designated 65. A right end 94 of the cross member 92 is attached to the second neck 84 at the second angle 65. In one embodiment the second angle 65 is equal to the first angle 63.

In another embodiment, the second angle 65 is greater than the first angle 63. In yet another embodiment, the second angle 65 is less than the first angle 63.

The tension end 60 of the left hook piece 34 is attached to the first shoulder 62 and the tension end 80 of the right hook piece 36 is attached to the second shoulder 82. Thus, the left hook piece 34 is attached to the right hook piece 36 through the cross member 92.

Figure 4:
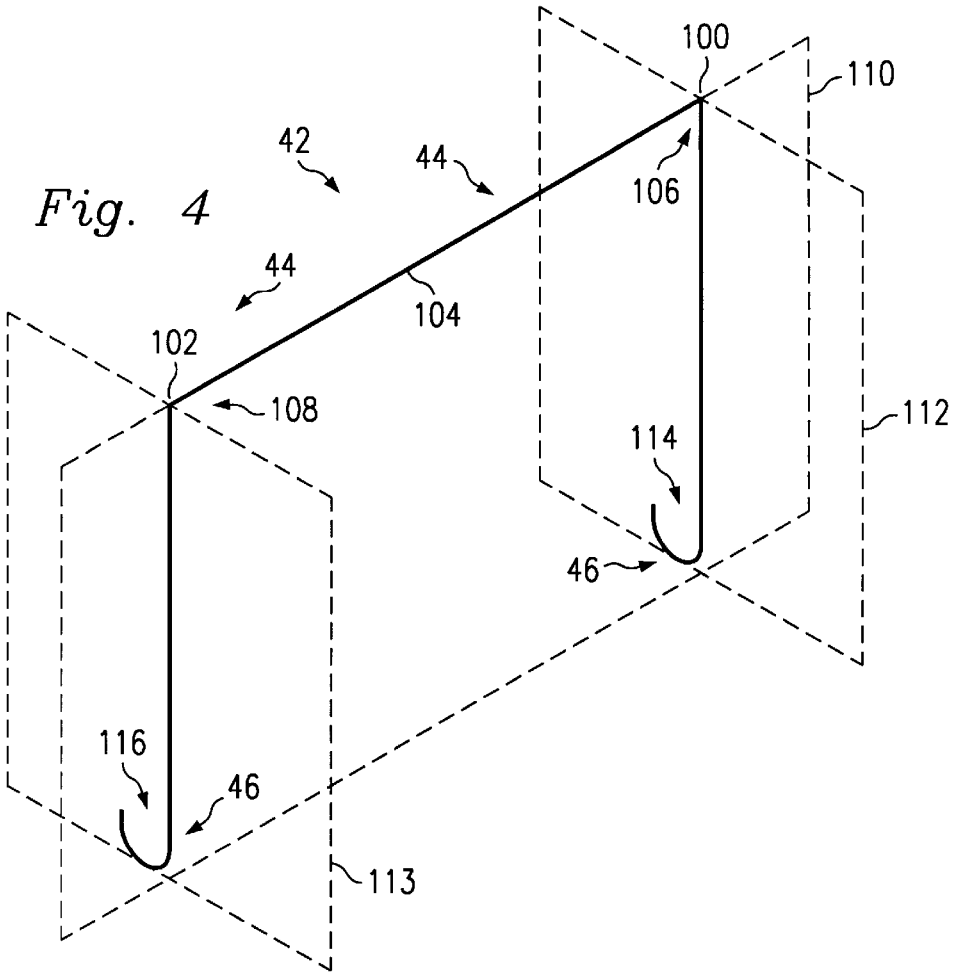
FIG. 4 is the support clip of FIG. 2 used, in conjunction with the tension clip of FIG. 3, to secure the vibrating device to the box spring mattress.

In FIG. 4, the support clip 42 has the support portion 44 and the hook portion 46. The support portion 44 has a first angle end 100, a second angle end 102, and a cross tension member 104. The cross tension member 104 has a left end 106 and a right end 108. The left end 106 is attached to the first angle end 100. The right end 108 is attached to the second angle end 102. The first angle end 100 and the second angle end 102 exists in a first plane designated 110. The hook portion 46 has a first latch end 114 existing in a second plane designated 112 and a second latch end 116 existing in a third plane designated 113. The first latch end 114 is connected to the first angle end 100. The second latch end 116 is connected to the second angle end 102. The first plane 110 is perpendicular to the second plane 112 and the second plane 112 is parallel to the third plane 113.

In another embodiment, the first plane 110 can be at an obtuse angle to the second plane 112 and third plane 113 by rotating the first latch end 114 and the second latch end 115 away from the cross tension member 104, respectively.

In yet another embodiment, the first plane 110 can be at an acute angle to the second plane 112 and the third plane 113 by rotating the first latch end 114 and the second latch end 115 toward the cross tension member 104, respectively.

Figure 5:
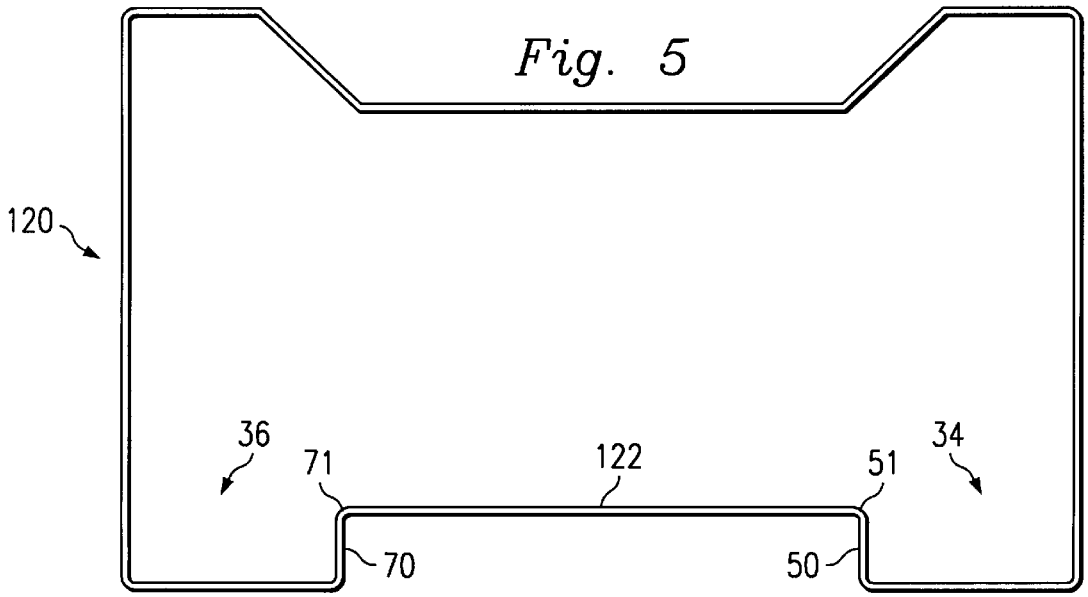
FIG. 5 is an alternative embodiment of the tension clip in FIG. 3.

FIG. 5 illustrates a reinforced tension clip, generally designated 120, which can be substituted for the tension clip 18. In addition to the components set forth above for the tension clip 18, the reinforced tension clip 120 has a retaining member 122 that attaches the left hook piece 34 to the right hook piece 36. This is accomplished by attaching one end of the retaining member 122 to the free end 51 of the first finger 50 and the other end of the retaining member 122 to the free end 71 of the second finger 70.

In another embodiment of the present invention a pair of tension clips 18, a pair of reinforced tension clips 120, or tension clip 18 and the reinforced tension clip 120 can be used to secure the vibrating device 16 to other types of bed systems. For example, the vibrating device 16 can be secured to a futon bed frame (not shown) using a second tension clip. The second tension clip engages the third slot 30 and the fourth slot 32 in the same way as the tension clip 18 engages the first slot 26 and the second slot 28. The tension clip 18 is secured to one lattice board of the futon bed frame using a pair of locking ties. Likewise, the second tension clip is secured to another lattice board of the futon bed frame using a secured pair of locking ties, thereby securing the vibrating device 16 to the futon bed frame.

Although illustrative embodiments have been shown and described, a wide range of modifications, changes and substitutions is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

what is claimed is:

1. A clip system for securing a vibrating device, having a housing defining a plurality of slots, to a box spring mattress, at least one slot of the plurality of slots engaging a lattice wire of the box spring mattress, comprising:

a tension clip. comprising:

mounting portion to engage at least one slot of the plurality of slots; and an indentation portion connected to and extending from the mounting portion, the indentation portion receiving a locking tie to secure the vibrating device to the box spring mattress;

wherein the mounting portion comprises:

a left hook piece connected to one end of the indentation portion, comprising:

a first finger;

a first handle attached at one end to the first finger for engaging a first slot of the plurality of slots; and a first arm having a handle end attached to an opposite end of the first handle and a tension end attached to the indentation portion; and a right hook piece connected to an other end of the indentation portion, comprising:

a second finger;

a second handle attached at one end to the second finger for engaging a second slot of the plurality of slots; and a second arm having a handle end attached to an opposite end of the second handle and a tension end attached to the indentation portion.

2. The clip system of claim 1 further comprising a retaining member attached at one end to the first finger and at an opposite end to the second finger.

3. The clip system of claim 1 wherein the indentation portion comprises:

a first indentation attached at one to the left hook piece;

a cross member attached at one end to an opposite end of the first indentation; and a second indentation attached at one end to an opposite end of the cross member and an opposite end of the second indentation is attached to the right hook piece.

4. The clip system of claim 1 further comprising:

a support clip to engage at least one other of the plurality of slots, the support clip comprising:

a support portion; and a hook portion attached to the support portion.

5. The clip system of claim 4 wherein the support portion comprises:

a cross tension member having a left end and a right end; and a first angle end for engaging a third slot of the plurality of slots; and a second angle end for engaging a fourth slot of the plurality of slots, wherein the left end of the cross tension member is attached to a free end the first finger and the right end of the cross tension member is attached a free end of the second finger.

6. The clip system of claim 4 wherein the first angle end and the second angle end exists in a first plane.

7. The clip system of claims 4 wherein the support clip further comprises:

a first latch existing in a second plane and extending from the first angle end to engage an other lattice wire of the box spring mattress; and a second latch end existing in a third plane and extending from the second angle end to engage the other lattice wire of the box spring mattress.

8. The clip system of claim 7 wherein the first plane is perpendicular to the second plane and the second plane is parallel to the third plane.

9. The clip system of claim 7 wherein the first plane is at an obtuse angle to the second plane and the third plane.

10. The clip system of claim 7 wherein the first plane is at an acute angle to the second plane and the third plane.

11. A clip system for securing a vibrating device to a box spring mattress comprising:

a first finger, having a free end and an angled end;

a first handle attached at one end to the angled end of the first finger;

a first arm having a handle end and a tension end, the handle end attached to an opposite end of the first handle;

a first shoulder attached at one end to the tension end;

a first neck attached at a first angle to an opposite end of the first shoulder;

a cross member attached at a second angle to an opposite end of the other end of the first shoulder;

a second neck attached at the second angle to an opposite end of the cross member;

a second shoulder attached at the first angle to an opposite end to the second neck;

a second arm having a handle end and a tension end, the tension end attached to an opposite end of the second shoulder;

a second handle attached at one end to the handle end of the second arm; and a second finger, having a free end and an angled end, the angled end of the second finger attached to an opposite end of the second handle.

12. An assembly for vibrating a bed system, the assembly comprising:

a vibrating device having a housing and a plurality of slots; and a tension clip comprising:

a mounting portion to engage at least one slot of the plurality of slots; and an indentation portion to engage at least one locking tie which in turn engages a first lattice member of the bed system;

wherein the indentation portion comprises at least one indentation for receiving the at least one locking tie which extends around the first lattice member of the bed system in order to secure the tension clip to the first lattice member.

13. The assembly of claim 12 further comprising:

a second tension clip comprising:

a mounting portion to engage at least one other slot of the plurality of slots; and an indentation portion to engage another locking tie which in turn engages a second lattice member of the bed system.

14. The assembly of claim 13 wherein the first and second tension clips are reinforced tension clips.

15. An assembly for vibrating a bed system, the assembly comprising:

a vibrating device having a housing and a plurality of slots; and a tension clip comprising:

a mounting portion to engage at least one slot of the plurality of slots; and an indentation portion to engage at least one locking tie which in turn engages a first lattice member of the bed system;

a support clip, the support clip comprising:

a cross tension member having a left end and a right end;

a first angle end for engaging a third slot of the plurality of slots, the first angle end existing in a first plane;

a second angle end for engaging a fourth slot of the plurality of slots, the second angle end also existing in the first plane, wherein the left end of the cross tension member is attached to one end of the first angle and the right end of the cross tension member is attached to one end of the second angle end;

a first latch end existing in a second plane and extending from the first angle end to engage a second lattice member of the bed system; and a second latch end existing in a third plane and extending from the second angle end to engage the second lattice member of the bed system.

16. The clip system of claim 15 wherein the first plane is perpendicular to the second plane and the second plane is parallel to the third plane.

17. The clip system of claim 15 wherein the first plane is at an angle to the second plane and the third plane.

18. An assembly for vibrating a bed system, the assembly comprising:

a vibrating device having a housing and a plurality of slots; and a tension clip comprising:

a mounting portion to engage at least one slot of the plurality of slots; and an indentation portion to engage at least one locking tie which in turn engages a first lattice member of the bed system;

wherein the plurality of slots are symmetrically spaced slots.

* * * * *